US009785097B1

(12) United States Patent
Hara et al.

(10) Patent No.: US 9,785,097 B1
(45) Date of Patent: Oct. 10, 2017

(54) TENSION APPLYING DEVICE, METHOD AND IMAGE FORMING APPARATUS

(71) Applicant: FUJI XEROX CO., LTD., Tokyo (JP)

(72) Inventors: Sota Hara, Ebina (JP); Hiroaki Yagi, Ebina (JP); Masaru Noguchi, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/223,912

(22) Filed: Jul. 29, 2016

(30) Foreign Application Priority Data

Mar. 15, 2016 (JP) ..... 2016-050461

(51) Int. Cl.
*G03G 15/00* (2006.01)
*G03G 15/16* (2006.01)

(52) U.S. Cl.
CPC . *G03G 15/1615* (2013.01); *G03G 2215/1623* (2013.01)

(58) Field of Classification Search
CPC ..... G03G 15/1615; G03G 2215/1623
USPC ..... 399/302, 121, 313, 165; 198/806
See application file for complete search history.

(56) References Cited

U.S. PATENT DOCUMENTS

2008/0219715 A1* 9/2008 Park ..... G03G 15/1615 399/302
2011/0293336 A1* 12/2011 Noso ..... G03G 15/1615 399/302
2014/0083821 A1* 3/2014 Hozumi ..... G03G 15/1615 198/806
2015/0314976 A1* 11/2015 Hozumi ..... G03G 15/1615 198/806
2016/0170336 A1* 6/2016 Oba ..... G03G 15/1615 399/302

FOREIGN PATENT DOCUMENTS

JP 2003-246483 A 9/2003
JP 2006-139048 A 6/2006

* cited by examiner

*Primary Examiner* — Sophia S Chen
(74) *Attorney, Agent, or Firm* — Oliff PLC

(57) ABSTRACT

A tension applying device that applies tension to a strip-shaped body supported on a support member, the tension applying device is provided with a moving body that supports the support member, a holding body movably supporting the moving body in a direction in which the tension is applied to the strip-shaped body, a tension spring exerting the tension to the strip-shaped body, a first spring support portion disposed in the holding body and supporting one end of the tension spring, a second spring support portion disposed in the moving body in order to support the other end of the tension spring and disposed on an upstream side from the first spring support portion in the direction in which the tension is applied, and an opening formed in the holding body and in a position corresponding to the second spring support portion.

3 Claims, 6 Drawing Sheets

RELATED ART

TENSION APPLYING DEVICE, METHOD AND IMAGE FORMING APPARATUS

CROSS-REFERENCE TO RELATED APPLICATIONS

This application is based on and claims priority under 35 USC 119 from Japanese Patent Application No. 2016-050461 filed on Mar. 15, 2016.

BACKGROUND

Technical Field

Exemplary embodiments of the invention relate to a tension applying device and an image forming apparatus.

SUMMARY

An aspect of the invention provides a tension applying device that applies tension to a strip-shaped body supported on a support member, the tension applying device including a moving body that supports the support member, a holding body that movably supports the moving body in a direction in which the tension is applied to the strip-shaped body, a tension spring that exerts the tension to the strip-shaped body, a first spring support portion that is disposed in the holding body and supports one end of the tension spring, a second spring support portion that is disposed in the moving body in order to support the other end of the tension spring and is disposed on an upstream side from the first spring support portion in the direction in which the tension is applied, and an opening that is formed in the holding body and in a position corresponding to the second spring support portion. The opening is formed in a cylindrical shape in order to house the second spring support portion in an inside thereof, and in order that a temporary holding portion that is able to hold the other end of the tension spring passes through the opening in a case where a temporary holding member having the temporary holding portion is mounted on the holding body. The second spring support portion is housed in the temporary holding portion in a case where the moving body is movably supported on the holding body from a state where the tension spring is supported between the first spring support portion and the temporary holding portion. The second spring support portion supports the other end of the tension spring falling off from the temporary holding portion in a case where the temporary holding member is removed from the holding body.

BRIEF DESCRIPTION OF THE DRAWINGS

Exemplary embodiments of the present invention will be described in detail based on the following figures, wherein:

FIG. 4A is a view that is viewed obliquely from a front side, and FIG. 4B is a view that is viewed obliquely from a rear side;

FIG. 5A is an explanatory view of a state before a temporary holding member is mounted on a holding body, FIG. 5B is an explanatory view of a state where a tension spring is mounted after the temporary holding member is mounted on the holding body, FIG. 5C is an explanatory view of a state where a moving body is mounted from a state illustrated in FIG. 5B, FIG. 5D is an explanatory view of a state where the temporary holding member is removed from a state illustrated in FIG. 5C, and FIG. 5E is an explanatory view of a state of being held in a tension release position; and FIGS. 6A and 6B are explanatory views of a tension applying device of the related art, of which FIG. 6A is an exploded view, and FIG. 6B is a view that is viewed in an arrow VIB direction of FIG. 6A.

DETAILED DESCRIPTION

Figure 1:
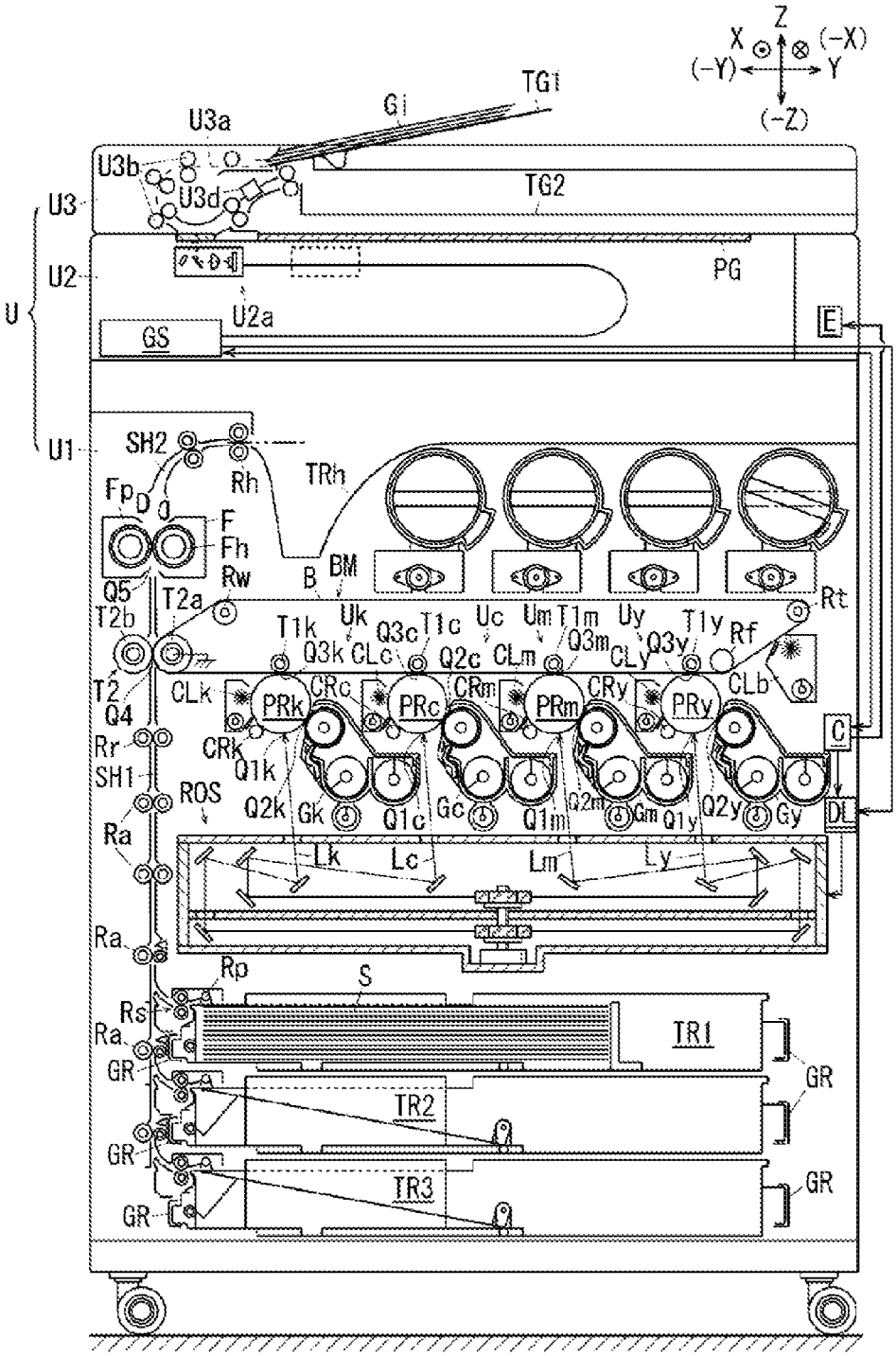
FIG. 1 is an entire explanatory view of an image forming apparatus of Example 1.

Next, specific examples (hereinafter, referred to examples) of exemplary embodiments of the invention will be described with reference to the drawings, but the invention is not limited to the following examples.

Moreover, in order to facilitate understanding of the following description, in the drawings, a forward and rearward direction is an X-axis direction, a rightward and leftward direction is a Y-axis direction, an upward and downward direction is a Z-axis direction, directions or sides indicated by arrow X, −X, Y, −Y, Z, and −Z are respectively a front side, a rear side, a right side, a left side, an upper side, and a lower side, or forward, rearward, rightward, leftward, upward, and downward.

In addition, in the drawings, a mark in which "●" is described in "○" means an arrow directed from the rear side to the front side of a paper surface and a mark in which "x" is described in "○" means an arrow directed from the front side to the rear side of the paper surface.

Moreover, in the following description using the drawings, in order to facilitate understanding, illustration other than members necessary for the description is appropriately omitted.

Example 1

FIG. 1 is an entire explanatory view of an image forming apparatus of Example 1.

In FIG. 1, a copier U as an example of the image forming apparatus of Example 1 of the invention is an example of a recording portion and has a printer portion U1 as an example of an image recording device. A scanner portion U2 as an example of a reading portion and as an example of an image reading device is supported on an upper portion of the printer portion U1. An automatic feeder U3 as an example of a transporting device of an original document is supported on an upper portion of the scanner portion U2.

An original document tray TG1, as an example of an accommodating container for a medium, is disposed in an upper portion of the automatic feeder U3. Plural original documents Gi to be copied are able to be accommodated in the original document tray TG1 by being overlapped. An original document ejection tray TG2 as an example of an original document exit portion is formed below the original document tray TG1. An original document transporting roll U3*b* is disposed between the original document tray TG1 and the original document ejection tray TG2 along an original document transporting path U3*a*.

A platen glass PG as an example of a transparent original document platen is disposed on an upper surface of the scanner portion U2. In the scanner portion U2 of Example 1, a reading unit U2*a* as an example of a reading portion is disposed below the platen glass PG. The reading unit U2*a* of Example 1 is movably supported in the rightward and leftward direction as an example of a sub-scanning direction along a lower surface of the platen glass PG. The reading unit U2*a* is stopped in an initial position indicated by a solid line of FIG. 1 at normal time. Moreover, the reading unit U2*a* is electrically connected to the image processing portion GS.

In addition, in the scanner portion U2 of Example 1, a reading sensor U3*d* as an example of a second reading member is disposed on a downstream side from a position facing the reading unit U2*a* in a transporting direction of the original document in the original document transporting path U3*a*. The reading sensor U3*d* and the reading unit U2*a* are configured to be able to read a surface opposite to the original document Gi.

Figure 2:
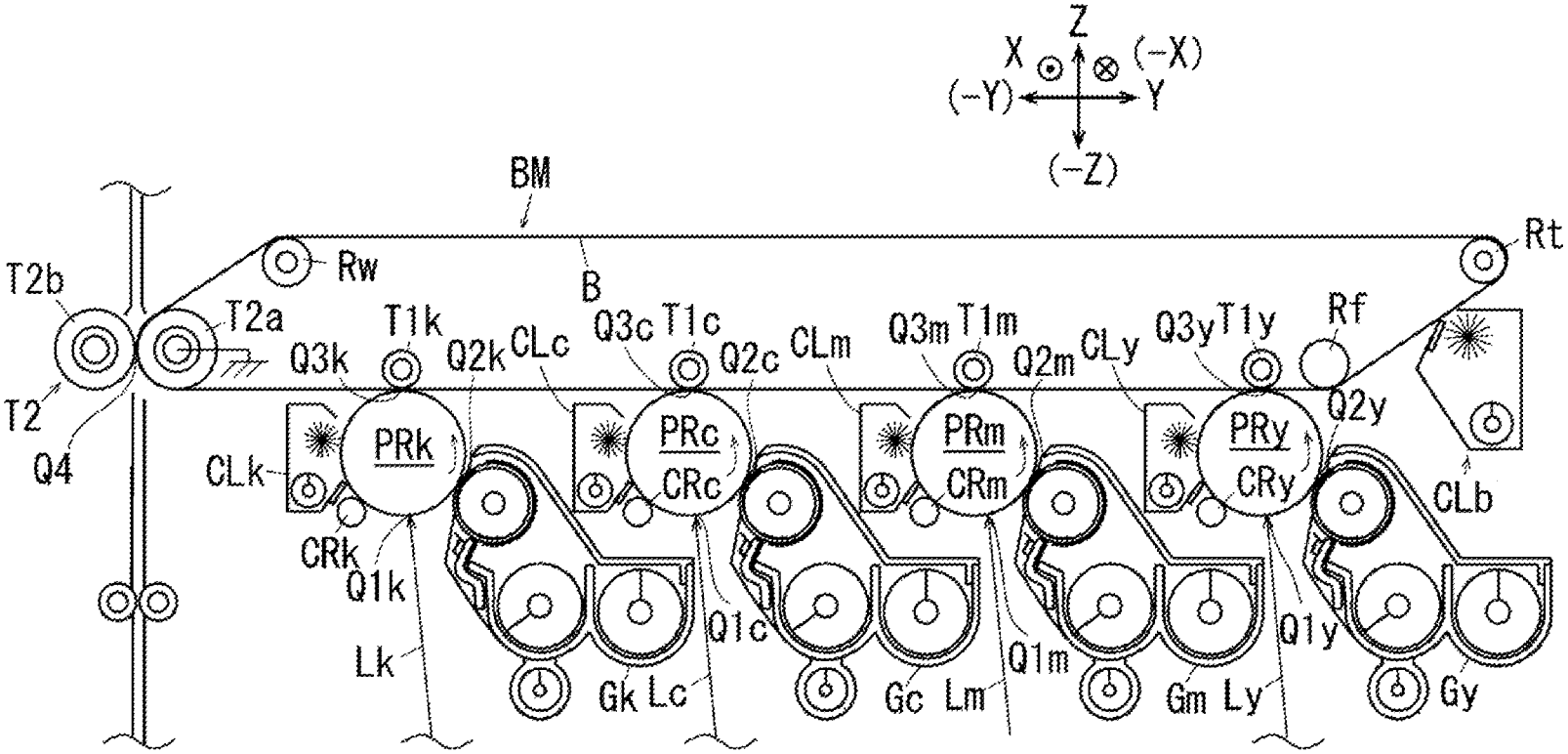
FIG. 2 is an explanatory view of a main portion of a recording portion of an image of Example 1.

FIG. 2 is an explanatory view of a main portion of an image recording portion of Example 1.

The image processing portion GS is electrically connected to a writing circuit DL of the printer portion U1. The writing circuit DL is electrically connected to an exposure device ROS as an example of a latent image forming device.

The exposure device ROS of Example 1 is configured to be able to output laser beams Ly, Lm, Lc, and Lk corresponding to each color of Y, M, C, and K as an example of writing light. The exposure device ROS is configured to be able to output the laser beams Ly to Lk corresponding to signals input from the writing circuit DL.

In FIG. 1, the photoconductors PRy, PRm, PRc, and PRk as an example of an image holding body is disposed above the exposure device ROS. In FIGS. 1 and 2, writing regions Q1*y*, Q1*m*, Q1*c*, and Q1*k* are configured by a region where the laser beams Ly to Lk are applied to each of the photoconductors PRy to PRk.

Charging rolls CRy, CRm, CRc, and CRk as an example of a charging device are disposed on an upstream side of the writing regions Q1*y* to Q1*k* in a rotating direction of each of the photoconductors PRy, PRm, PRc, and PRk. The charging rolls CRy to CRk of Example 1 is rotatably supported to be driven by being in contact with the photoconductors PRy to PRk.

The developing devices Gy, Gm, Ge, and Gk are disposed on the downstream side of the writing regions Q1*y* to Q1*k* in the rotating direction of the photoconductors PRy to PRk. Developing regions Q2*y*, Q2*m*, Q2*c*, and Q2*k* are configured by a region in which each of the photoconductors PRy to PRk faces each of the developing devices Gy to Gk.

Primary transfer rolls T1*y*, T1*m*, T1*c*, and T1*k* as an example of a primary transfer device are disposed on the downstream side of the developing devices Gy to Gk in the rotating direction of the photoconductors PRy to PRk. Primary transfer regions Q3*y*, Q3*m*, Q3*c*, and Q3*k* are configured of a region in which each of the photoconductors PRy to PRk faces each of the primary transfer rolls T1*y* to T1*k*.

Photoconductor cleaners CLy, CLm, CLc, and CLk as an example of a cleaning unit of the image holding body are disposed on a downstream side of the primary transfer rolls T1*y* to T1*k* in the rotating direction of the photoconductors PRy to PRk.

An image forming portion Uy, forming a toner image of Y color as an example of a forming device of a visible image of Y color of Example 1, is configured of the photoconductor PRy of Y color, the charging roll CRy, the exposure device ROS outputting the laser beam Ly of Y color, the developing device Gy, the primary transfer roll T1*y*, and the photoconductor cleaner CLy. Similarly, image forming portions Um, Uc, and Uk of M, C, and K colors are respectively configured of the photoconductors PRm, PRc, and PRk, the charging rolls CRm, CRc, and CRk, the exposure device ROS, the developing devices Gm, Gc, and Gk, the primary transfer rolls T1*m*, T1*c*, and T1*k*, and the photoconductor cleaners CLm, CLc, and CLk.

A belt module BM as an example of an intermediate transfer device is disposed above the photoconductors PRy to PRk. The belt module BM has an intermediate transfer belt B as an example of an image holding body and as an example of the intermediate transfer body. The intermediate transfer belt B is configured of an endless strip-shaped member.

The intermediate transfer belt B of Example 1 is rotatably supported by a tension roll Rt as an example of a tension member, a walking roll Rw as an example of a member for correcting deviation, an idler roll Rf as an example of a driven member, a backup roll T2*a* as an example of a facing member of the secondary transfer region, and the primary transfer rolls T1*y*, T1*m*, T1*c*, and T1*k*. Moreover, in Example 1, in a case where driving is transmitted to the backup roll T2*a* as an example of a driving member, the intermediate transfer belt B is rotated.

A secondary transfer roll T2*b* as an example of a secondary transfer member is disposed in a position facing the backup roll T2*a* in which the intermediate transfer belt B is interposed therebetween. In Example 1, the backup roll T2*a* is grounded and a secondary transfer voltage having a polarity opposite to a charging polarity of toner is applied from a power supply circuit E to the secondary transfer roll T2*b*. A secondary transfer device T2 of Example 1 is configured of the backup roll T2*a* and the secondary transfer roll T2*b*. In addition, a secondary transfer region Q4 is configured of a region in which the secondary transfer roll T2*b* is in contact with the intermediate transfer belt B.

A belt cleaner CLb as an example of a cleaning unit of the intermediate transfer body is disposed on the downstream side of the secondary transfer region Q4 in the rotating direction of the intermediate transfer belt B.

A transfer device T1+T2+B of Example 1 is configured of the primary transfer rolls T1*y* to T1*k*, the intermediate transfer belt B, the secondary transfer device T2, and the like. In addition, an image recording portion Uy to Uk+T1+T2+B of Example 1 is configured of the image forming devices Uy to Uk and the transfer device T1+T2+B.

In FIG. 1, three steps of a pair of right and left guide rails GR as an example of a guide member are provided below the image forming devices Uy to Uk. Paper feed trays TR1 to TR3 as an example of a medium accommodating unit are supported on each guide rail GR to go in and out in the forward and rearward direction. Sheets S as an example of a medium are housed in the paper feed trays TR1 to TR3.

A pickup roll Rp as an example of a take-out member is disposed on the left side above the paper feed trays TR1 to TR3. A sorting roll Rs as an example of a sorting member is disposed on a downstream side of the pickup roll Rp in the transporting direction of the recording sheet S. A paper feeding path SH1 extending upward as an example of the transporting path of the medium is formed on the downstream side of the sorting roll Rs in the transporting direction of the sheet S. Plural transporting rolls Ra as an example of the transporting member is disposed in the paper feeding path SH1.

In the paper feeding path SH1, a registration roll Rr as an example of an adjusting member of a transporting timing is disposed on an upstream side of the secondary transfer region Q4.

A fixing device F is disposed on a downstream side of the secondary transfer region Q4 in the transporting direction of the recording sheet S. The fixing device F has a heating roll Fh as an example of a fixing member for heating and a pressing roll Fp as an example of a fixing member for pressing. A fixing region Q5 is configured of a contact region between the heating roll Fh and the pressing roll Fp.

A paper ejection path SH2 as an example of a transporting path is disposed above the fixing device F. A paper ejection tray TRh as an example of an exit portion of the medium is formed on an upper surface of the printer portion U1. The paper ejection path SH2 extends toward the paper ejection tray TRh. A paper ejection roll Rh as an example of the transporting member of the medium is disposed on a downstream side of the paper ejection path SH2.

Description of Image Forming Operation

In the copier U of Example 1 including the configuration described above, in a case where an operator performs copy by manually placing the original document Gi on the platen glass PG, the reading unit U2*a* is moved from the initial position in the rightward and leftward direction, and the original document Gi on the platen glass PG is scanned while being exposed by light. In addition, in a case where the operator performs copy by automatically transporting the original document Gi by using the automatic feeder U3, the reading unit U2*a* is moved from the initial position to a reading position of the original document indicated by a broken line of FIG. 1 and is stopped. Then, the plural original documents Gi housed in the original document tray TG1 are sequentially transported and pass through the reading position of the original document on the platen glass PG, and are discharged to the original document ejection tray TG2. Therefore, each original document Gi sequentially passing through the reading position on the platen glass PG is exposed and scanned in the stopped reading unit U2*a*. Moreover, a reflection light from the original document Gi is received by the reading unit U2*a*. The reading unit U2*a* converts the received reflection light of the original document Gi into an electrical signal. Moreover, in a case where duplex reading of the original document Gi is performed, the original document Gi is also read in the reading sensor U3*d*.

The electrical signal output from the reading unit U2*a* is input into the image processing portion GS. The image processing portion GS converts electrical signals of images of colors of R, G, and B read by the reading unit U2*a* into image information of yellow Y, magenta M, cyan C, and black K for forming a latent image. The image processing portion GS outputs the image information after the conversion to the writing circuit DL of the printer portion U1. Moreover, in a case where the image is a monochromatic image, a so-called monochrome, the image processing portion GS outputs the image information of only black K to the writing circuit DL.

The writing circuit DL outputs a control signal in accordance with the input image information to the exposure device ROS. The exposure device ROS outputs the laser beams Ly to Lk in accordance with the control signal.

Each of the photoconductors PRy to PRk is driven to be rotated if the image formation is started. A charging voltage is applied from the power supply circuit E to the charging rolls CRy to CRk. Therefore, surfaces of the photoconductors PRy to PRk are charged by the charging rolls CRy to CRk. Electrostatic latent images are formed on the surface of the charged photoconductors PRy to PRk by the laser beams Ly to Lk in the writing regions Q1*y* to Q1*k*. The electrostatic latent images of the photoconductors PRy to PRk are developed to toner images as an example of the visible image by the developing devices Gy, Gm, Ge, and Gk in the developing regions Q2*y* to Q2*k*.

The developed toner image is transported to the primary transfer regions Q3*y*, Q3*m*, Q3*c*, and Q3*k* which are in contact with the intermediate transfer belt B as an example of the intermediate transfer body. In the primary transfer regions Q3*y*, Q3*m*, Q3*c*, and Q3*k*, a primary transfer voltage having a polarity opposite to the charging polarity of toner is applied from the power supply circuit E to the primary transfer rolls T1*y* to T1*k*. Therefore, the toner image on each of the photoconductors PRy to PRk is transferred to the intermediate transfer belt B by the primary transfer rolls T1*y* to T1*k*. Moreover, in a case of the toner image of multi-color, the toner image on the downstream side is transferred by being overlapped to the toner image transferred to the intermediate transfer belt B in the primary transfer region on the upstream side.

A residue and an adhering matter of the photoconductors PRy to PRk after the primary transfer are cleaned by the photoconductor cleaners CLy to CLk. The surfaces of the cleaned photoconductors PRy to PRk are charged again by the charging rolls CRy to CRk.

The monochromatic or multi-color toner image transferred on the intermediate transfer belt B by the primary transfer rolls T1*y* to T1*k* in the primary transfer regions Q3*y* to Q3*k* is transported to the secondary transfer region Q4.

The recording sheet S on which the image is recorded is taken out by the pickup roll Rp of the paper feed trays TR1 to TR3 which is used. In a case where plural recording sheets S are taken out by being overlapped, the recording sheets S that are taken out by the pickup roll Rp are separated one by one by the sorting roll Rs. The recording sheets S separated one by one by the sorting roll Rs are transported to the paper feeding path SH1 by the transporting roll Ra. The recording sheets S transported to the paper feeding path SH1 are delivered to the registration roll Rr.

The registration roll Rr transports the recording sheet S to the secondary transfer region Q4 in accordance with timing when the toner image formed in the intermediate transfer belt B is transported to the secondary transfer region Q4. A secondary transfer voltage having a polarity opposite to the charging polarity of toner is applied to the secondary transfer roll T2*b* by the power supply circuit E. Therefore, the toner image on the intermediate transfer belt B is transferred from the intermediate transfer belt B to the recording sheet S.

The adhering matter and the like adhered to the surface of the intermediate transfer belt B after the secondary transfer is cleaned by the belt cleaner CLb.

The recording sheet S to which the toner image is secondarily transferred is heated and fixed when passing through the fixing region Q5.

The recording sheet S to which the image is fixed is transported to the paper ejection path SH2. The recording sheet S transported to the paper ejection path SH2 is discharged to the paper ejection tray TRh by the paper ejection roll Rh.

Description of Tension Applying Device

Figure 3:
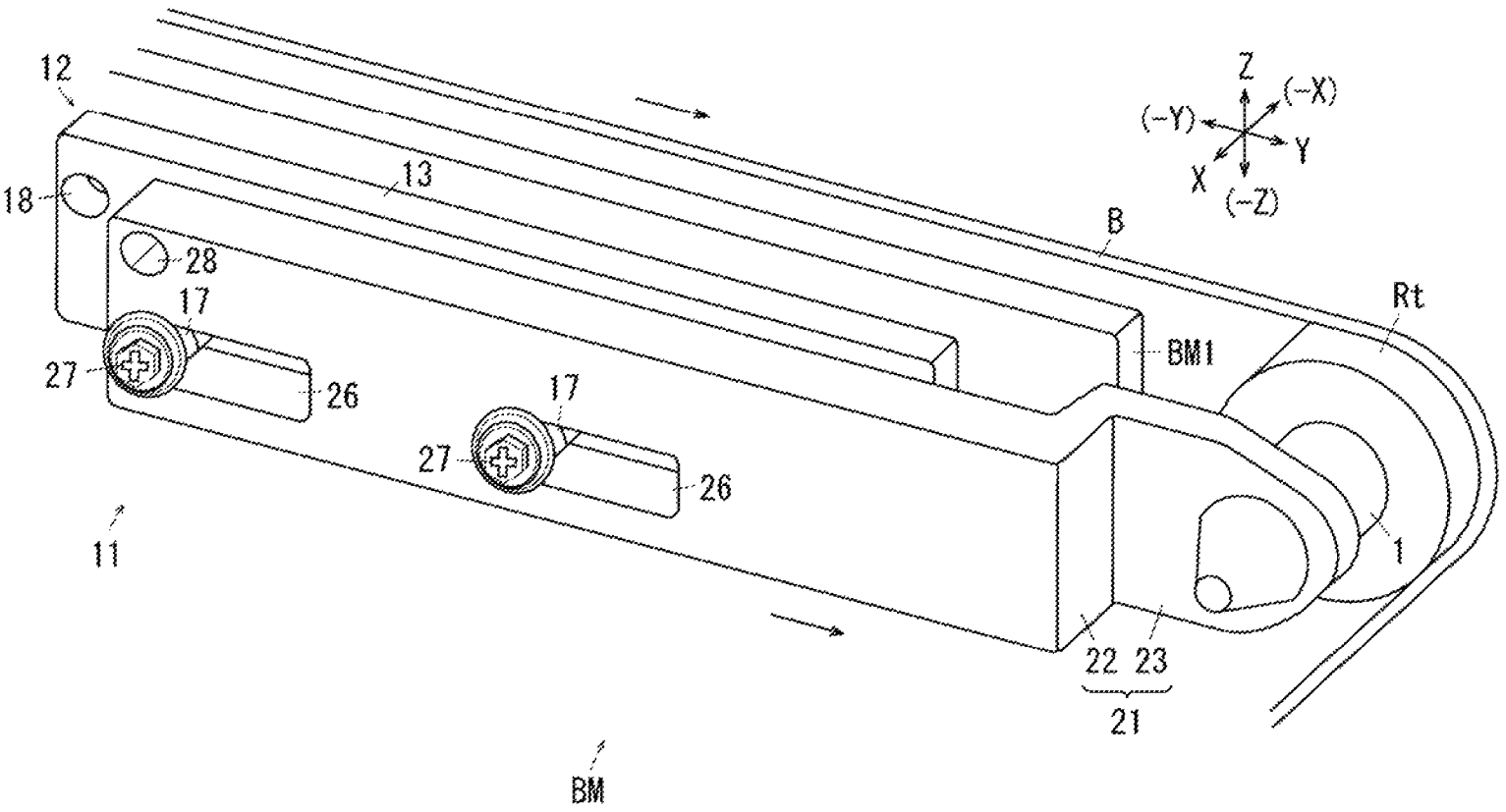
FIG. 3 is an explanatory view of a portion of a tension applying device of an intermediate transfer belt of Example 1.

FIG. 3 is an explanatory view of a portion of a tension applying device of the intermediate transfer belt of Example 1.

Figure 4A:
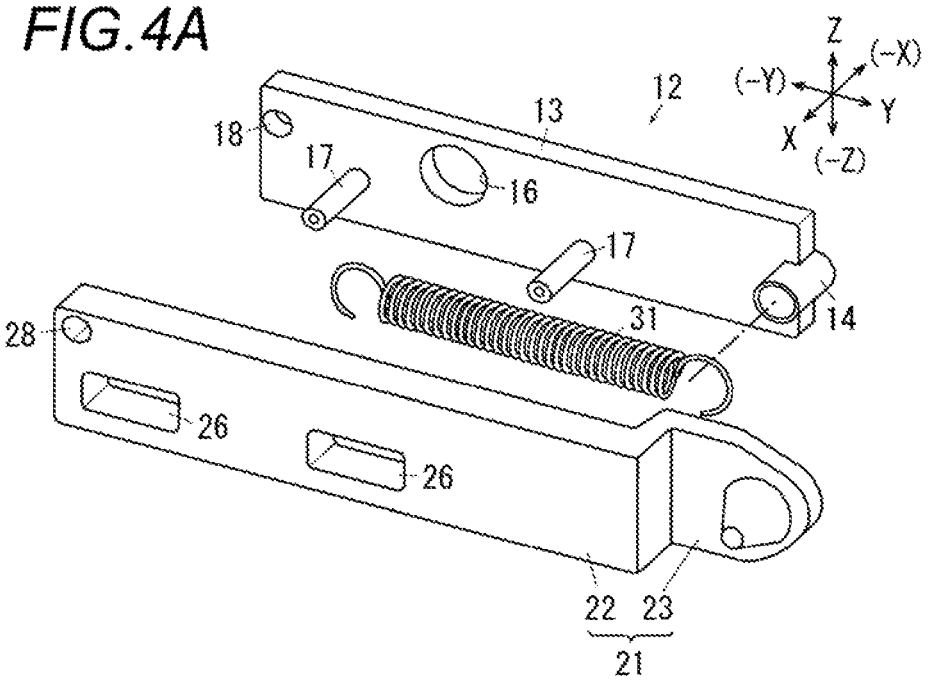
FIGS. 4A and 4B are exploded views of the tension applying device of Example 1.
Figure 4B:
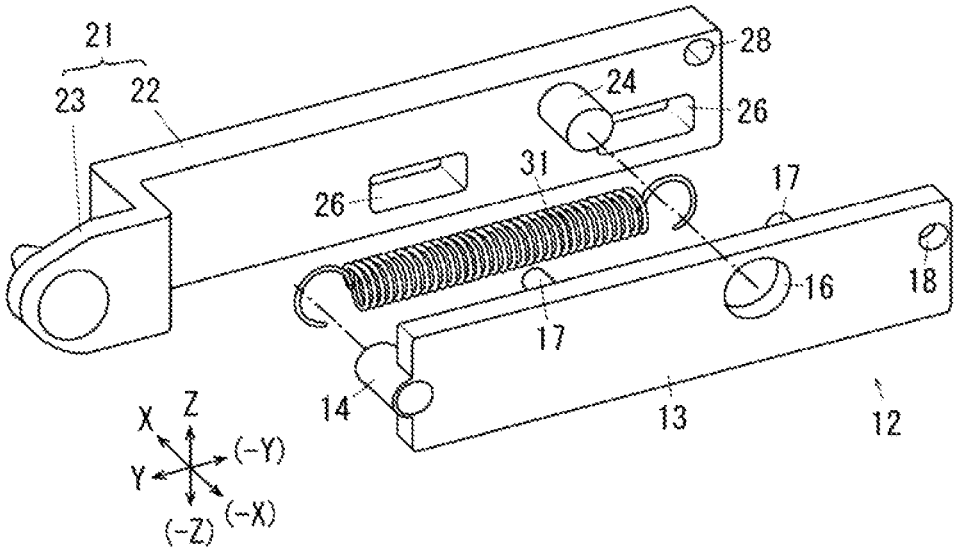

FIGS. 4A and 4B are exploded views of the tension applying device of Example 1, FIG. 4A is a view that is viewed obliquely from a front side, and FIG. 4B is a view that is viewed obliquely from a rear side.

In FIG. 3, the intermediate transfer belt B as an example of a strip-shaped body is supported on the tension roll Rt as an example of a tension applying member and as an example of a support member. Both ends of a rotation shaft 1 of the tension roll Rt are supported on a tension mechanism 11 as an example of a tension applying device. Moreover, a pair of the tension mechanisms 11 are disposed back and forth, and are configured symmetrically back and forth. Therefore, the forth tension mechanism 11 is described and the description of the back tension mechanism 11 will be omitted.

In FIGS. 3 to 4B, the tension mechanism 11 of Example 1 has a base 12 as an example of a holding body. In FIG. 3, the base 12 is supported on a frame body (frame) BM1 of the belt module BM.

In FIGS. 3 to 4B, the base 12 has a planar base body 13. A base projection 14 as an example of a first spring support portion is formed in a right end of the base body 13. The base projection 14 is formed in a hollow cylindrical shape.

A work hole 16 as an example of an opening is formed on the left side of the base projection 14.

A pair of right and left guide projections 17 as an example of a guide member are formed below the work hole 16.

A tension release hole 18 as an example of a tension release portion is formed in a left upper portion of the base body 13.

In FIGS. 3 to 4B, a slider 21 as an example of a moving body is supported on an outside, that is, a front side of the base 12. The slider 21 has a slider main body 22 as an example of a main body of the moving body. The slider main body 22 of Example 1 is formed in a plate shape. A roller support portion 23 as an example of a support portion of a support member is integrally formed in a right portion of the slider main body 22. The roller support portion 23 is formed in a stepped shape to be recessed into an inside, that is, a rear side of the slider main body 22. The rotation shaft 1 of the tension roll Rt is rotatably supported on the roller support portion 23.

A slider projection 24 as an example of a second spring support portion is formed on a rear surface of the slider main body 22. The slider projection 24 is formed in a cylindrical shape projecting rearward. In addition, the slider projection 24 is formed to have a diameter smaller than a diameter of the work hole 16.

A guide groove 26 as an example of a guided portion is formed in a lower portion of the slider main body 22. The guide groove 26 is formed in a long hole shape extending in the rightward and leftward direction. In addition, the guide groove 26 is formed in a position corresponding to the guide projection 17. Furthermore, the guide groove 26 is formed to have a width through which the guide projection 17 is able to pass and a length in which the guide projection 17 is able to relatively move in the rightward and leftward direction. Therefore, a screw 27 having a screw head of which a diameter is greater than the guide groove 26 is fastened to a tip of the guide projection 17 passing through the guide groove 26 and thereby the slider 21 is movably supported on the base 12 in the rightward and leftward direction.

A tension release hole 28 as an example of a ten release portion is formed in a left upper portion of the slider main body 22. In a case where the slider 21 is moved with respect to the base 12 in the left side, the tension release hole 28 is formed in a position in which the tension release hole 28 is able to match the tension release hole 18 of the base 12.

A tension spring 31 is disposed between the base 12 and the slider 21. One end of the tension spring 31 is supported on the base projection 14 and the other end is supported on the slider projection 24. The tension spring 31 is sandwiched between the base body 13 and the slider main body 22, and is held in a state of being housed on the inside.

Description of Assembling Method of Tension Applying Device

Figure 5A:
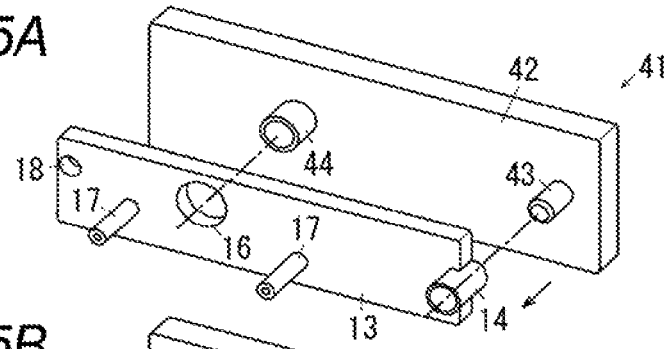
FIGS. 5A to 5E are explanatory views of an assembling method of the tension applying device of Example 1.
Figure 5B:
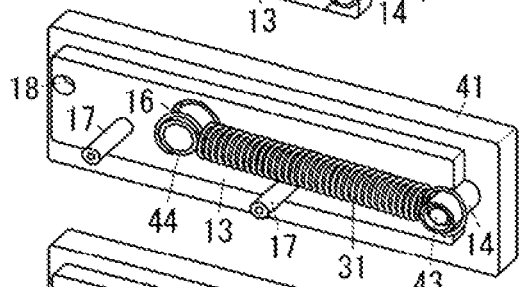
Figure 5C:
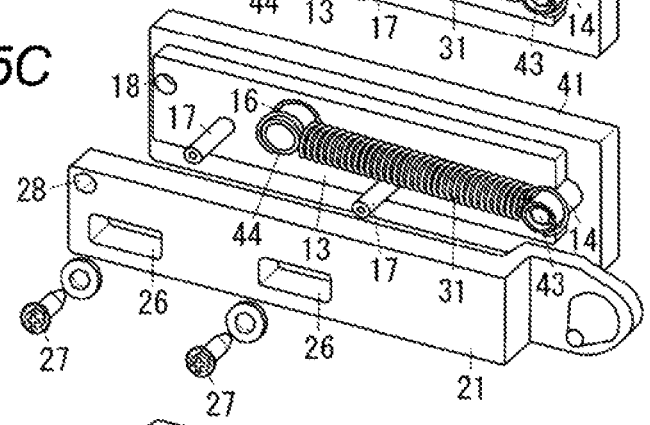
Figure 5D:
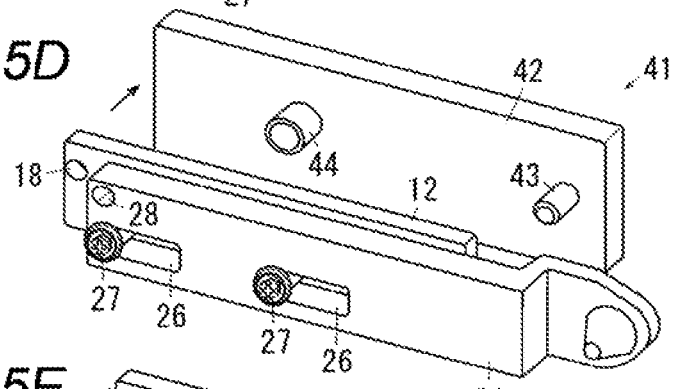
Figure 5E:
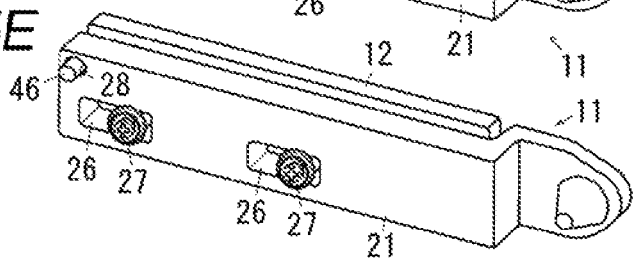

FIGS. 5A to 5E are explanatory views of an assembling method of the tension applying device of Example 1, FIG. 5A is an explanatory view of a state before a temporary holding member is mounted on a holding body, FIG. 5B is an explanatory view of a state where the tension spring is mounted after the temporary holding member is mounted on the holding body, FIG. 5C is an explanatory view of a state where the moving body is mounted from a state illustrated in FIG. 5B, FIG. 5D is an explanatory view of a state where the temporary holding member is removed from a state illustrated in FIG. 5C, and FIG. 5E is an explanatory view of a state of being held in a tension release position.

In FIGS. 5A to 5E, in a case where the tension mechanism 11 of Example 1 is assembled, a jig 41 as an example of the temporary holding member is used. The jig 41 has a planar jig body 42. A holding projection 43 as an example of a jig holding portion is formed in a position corresponding to the base projection 14 in the jig body 42. An outer diameter of the holding projection 43 is formed to have a size through which the base projection 14 passes. A temporary holding cylinder 44 as an example of a temporary holding portion is formed in a position corresponding to the work hole 16 in the jig body 42. The temporary holding cylinder 44 is formed in a cylindrical shape. The temporary holding cylinder 44 is formed to have an outer diameter smaller than a diameter of the work hole 16 and an inner diameter greater than an outer diameter of the slider projection 24.

In FIG. 5A, in a case where the tension mechanism 11 is assembled, first, the jig 41 is mounted on the base 12. That is, the holding projection 43 is inserted into the base projection 14 of the base 12 and the temporary holding cylinder 44 is in a state of passing through the work hole 16.

In FIG. 5B, the tension spring 31 is mounted between the base projection 14 and the temporary holding cylinder 44. In this case, the mounting is performed in a state where the tension spring 31 is extended, that is, being elastically deformed.

In FIG. 5C, the slider 21 is mounted on the base 12. That is, the guide projection 17 of the base 12 passes through the guide groove 26 of the slider 21 and the slider projection 24 of the slider 21 is housed on the inside of the temporary holding cylinder 44. Then, the screw 27 is coupled to the guide projection 17 and the slider 21 is movably supported on the base 12.

In FIG. 5D, the jig 41 is removed from the base 12 and the assembly of the tension mechanism 11 is completed.

In FIG. 5E, in a state where the slider 21 is moved to the left side with respect to the base 12, that is, in a direction in which the tension of the intermediate transfer belt B is reduced, the positions of the tension release holes 18 and 28 are aligned, and a pin 46 passes through the tension release holes 18 and 28. Therefore, it is possible to hold the tension mechanism 11 in a state of the tension is reduced.

Function of Tension Applying Device Example 1

In the tension mechanism 11 of Example 1 including the configuration described above, the rotation shaft 1 of the tension roll Rt is supported on the slider 21 and the slider 21 is pushed on the right side by an elastic force of the tension spring 31, that is, in a direction in which the tension acts on the intermediate transfer belt B. Therefore, the intermediate transfer belt B is supported on the tension roll Rt in a state where the tension acts.

Figure 6A:
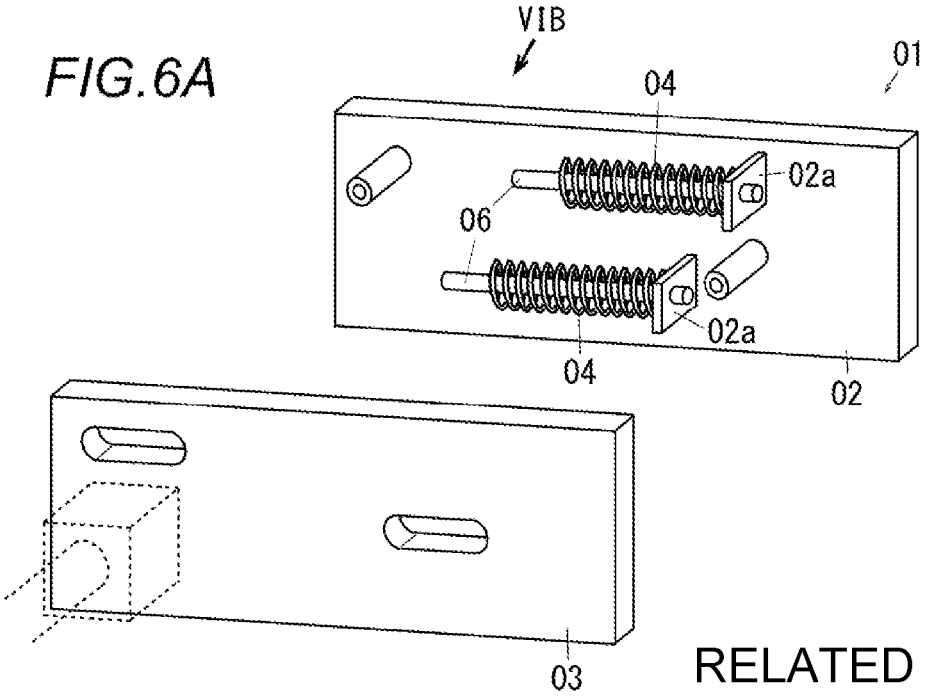
Figure 6B:
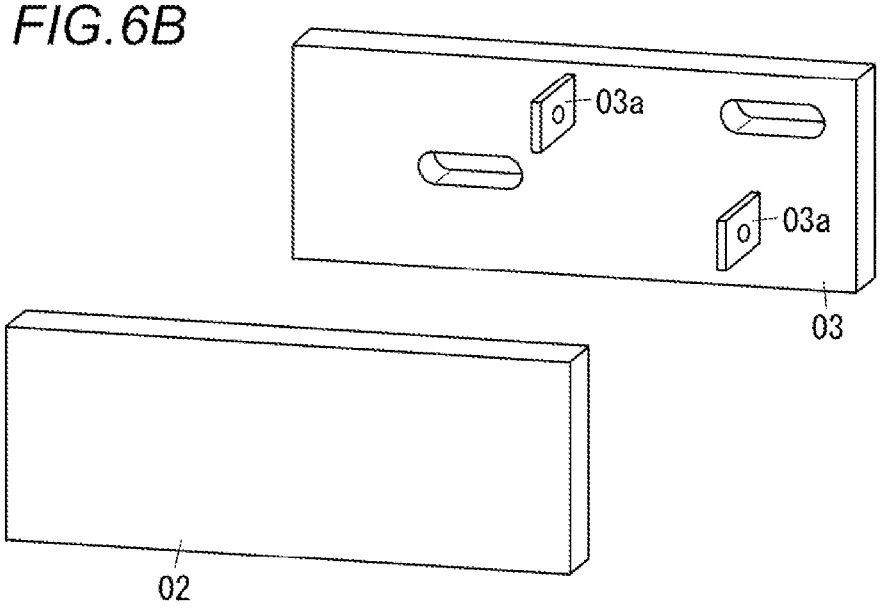
RELATED ART FIG.6B

FIGS. 6A and 6B are explanatory views of a tension applying device of the related art, FIG. 6A is an exploded view, and FIG. 6B is a view that is viewed in an arrow VIB direction of FIG. 6A.

In FIGS. 6A and 6B, in a case where a tension mechanism 01 is configured of a base 02 and a slider 03, it is necessary to support one end of a spring 04 on a base support portion 02*a* of the base 02 and to support the other end of the spring 04 on a slider support portion 03*a* of the slider 03.

As illustrated in FIGS. 6A and 6B, in a case where the spring 04 is a compression spring, a distance between the support portions 02*a* and 03*a* is shorter than a natural length of the spring 04. Therefore, in a state where the spring 04 is compressed, that is, is elastically deformed, it is necessary to press ends of the spring 04 to the support portions 02*a* and 03*a*. Therefore, if the ends of the spring 04 are aligned to the support portions 02*a* and 03*a* while compressing the spring 04, the spring 04 may be buckled. If the assembly is performed so as not to be buckled, an assembly work is very hard, the spring 04 is jumped up by buckling, the spring 04 is splashed during buckling, and then there is a concern that a worker is injured or peripheral devices are damaged. It is also conceivable that core materials 06 passing through the springs 04 are used so that the springs 04 are not buckled, but if the core materials 06 are used, there is a problem that the number of components is increased. In addition, there is also a problem that a step of mounting the core materials 06 on the springs 04 is added, it takes a long period of time to entire assembly work, and a manufacturing cost is increased. Furthermore, there is also a problem that the core materials 06 are bothered, the springs 04 are unlikely to be compressed, and then the assembly work is worsened.

On the other hand, in a case where a tension spring is used as in a configuration described in JP-A-2003-246483, when mounting the spring, if at least an end portion is not exposed, it is difficult to mount one end of the spring on a support portion by pulling the spring. If the spring is exposed, when an inside of the image forming apparatus is opened during paper jam, inspection, exchange, and the like, there is a concern that impact is erroneously applied to the vicinity of the spring, and the spring falls off. When the spring falls off, the flipped spring injures the worker, and the like, and there is a problem in safety. In order to reduce falling-off of the spring, if the spring is surrounded by a base and a slider, and a slit is formed to mount the spring on the base or the slider, there is a concern that strength of the base or the slider is insufficient by the spring. In addition, there is also a problem that workability of work through the slit is poorer than that of exposing.

Moreover, even in a case where the spring 04 is the compression spring or the tension spring, in the configuration of the related art, if a spring force of the spring 04 is strong, there is a problem that workability and safety are further worsened or insufficient strength is likely to be worsened.

In contrast, in the tension mechanism 11 of Example 1, in a state where the other end of the tension spring 31 is mounted on the temporary holding cylinder 44 passing through the work hole 16 and the slider 21 is mounted on the base 12 by using the jig 41, the other end of the tension spring 31 is supported on the slider projection 24 only by removing the jig 41. Therefore, in the tension mechanism 11 of Example 1, there is no fear of buckling of the tension spring 31, workability of assembly is improved, safety is improved, the core materials 06 are not required, and an increase in the number of the components is also suppressed compared to a case where the compression spring is used.

In addition, in the tension mechanism 11 of Example 1, the tension spring 31 is sandwiched between the base 12 and the slider 21, and is not exposed to the outside compared to the configuration described in JP-A-2003-246483. Therefore, the falling-off of the spring is reduced and safety is improved. Furthermore, in Example 1, only the work hole 16 for mounting the tension spring 31 is formed in the base 12 and an decrease in the strength is also suppressed compared to a case where the slit is formed.

In addition, in Example 1, as illustrated in FIGS. 5C, 5D, and 5E, extension of the tension spring 31 of the state of FIG. 5E is greater than those of the states of FIGS. 5C and 5D. That is, when mounting the tension spring 31 by using the jig 41, the extension of the tension spring 31 is suppressed compared to the state of FIG. 5E in which the tension of the intermediate transfer belt B is reduced. Therefore, in Example 1, a force for extending the tension spring 31 becomes small when the tension spring 31 is mounted on the temporary holding cylinder 44 by using the jig 41, compared to a case where mounting is performed by extending the tension spring 31 as in the state of FIG. 5E. Therefore, assembly workability and safety are improved compared to a case where the mounting is performed by extending the tension spring 31 as in the state of FIG. 5E. In addition, in a case where the slider 21 is moved to the state of FIG. 5E after mounting the slider 21 on the base 12, the work for holding the slider 21 to move, which has a size greater than that of the end of the spring, is facilitated compared to a case where the end of the tension spring 31 is held to extend the tension spring 31. Then, in a state of being illustrated in FIG. 5E, the intermediate transfer belt B is fixed to the frame body BM1 of the belt module BM and the pin 46 is removed, and thereby it is possible to apply the tension to the intermediate transfer belt B.

MODIFICATION EXAMPLES

Above, the exemplary example of the invention is described in detail, but exemplary embodiments of the invention are not limited to the example, and various modifications can be performed within the range of the gist of exemplary embodiments of the invention described in the claims. Modification examples 1 to 3 of the exemplary embodiments of the invention are exemplified as follows.

Modification Example 1

In the exemplary example described above, the copier U is exemplified as an example of the image forming apparatus, but the image forming apparatus is not limited to the copier U, and it is possible to apply to a FAX, a printer, and a multifunction machine having plural functions such as the copier. In addition, the exemplary example of the invention is not limited to the electrophotographic image forming apparatus and can be applied to an image forming apparatus of arbitrary image forming type such as a printer of lithography including an ink jet recording type, a thermal head type, and the like. In addition, the image forming apparatus is not limited to the multi-color image forming apparatus and may be configuration of a single color, that is, a monochromatic image forming apparatus.

Modification Example 2

In the exemplary example described above, the intermediate transfer belt B as an example of the strip-shaped body is exemplified, but the strip-shaped body is not limited to the intermediate transfer belt B. For example, a belt-shaped photoconductor, a transporting belt for transporting the recording sheet S, or a belt-shaped fixing device may be also examples of the strip-shaped body in the tension applying mechanism.

Modification Example 3

In the exemplary example described above, the configuration in which one tension spring 31 is provided is exemplified, but the exemplary example of the invention is not limited to the configuration. For example, as in the configuration described in FIGS. 6A and 6B, the tension applying device having two or more springs can be provided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A tension applying device that applies tension to a strip-shaped body supported on a support member, the tension applying device comprising:

a moving body that supports the support member;

a holding body that movably supports the moving body in a direction in which the tension is applied to the strip-shaped body;

a tension spring that exerts the tension to the strip-shaped body;

a first spring support portion that is disposed in the holding body and supports one end of the tension spring;

a second spring support portion that is disposed in the moving body in order to support the other end of the tension spring, and is disposed on an upstream side from the first spring support portion in the direction in which the tension is applied;

an opening that is formed in the holding body and in a position corresponding to the second spring support portion; and wherein the opening is formed in a cylindrical shape in order to house the second spring support portion in an inside thereof, and in order that a temporary holding portion that is able to hold the other end of the tension spring passes through the opening in a case where a temporary holding member having the temporary holding portion is mounted on the holding body, wherein the second spring support portion is housed in the temporary holding portion in a case where the moving body is movably supported on the holding body from a state where the tension spring is supported between the first spring support portion and the temporary holding portion, and wherein the second spring support portion supports the other end of the tension spring falling off from the temporary holding portion in a case where the temporary holding member is removed from the holding body.

2. An image forming apparatus comprising:

an image holding body having an endless strip-shaped body;

a tension applying member having a support member supporting the image holding body; and the tension applying device according to claim 1 that applies the tension to the image holding body via the tension applying member.

3. A tension applying method for applying tension to a strip-shaped body supported on a support member, the tension applying method comprising:

supporting a support member;

movably supporting a moving body in a direction in which the tension is applied to a strip-shaped body;

exerting the tension to the strip-shaped body;

disposing a first spring support portion in a holding body to support one end of a tension spring;

disposing a second spring support portion in a moving body to support the other end of the tension spring and on an upstream side from the first spring support portion in the direction in which the tension is applied;

forming an opening in the holding body and in a position corresponding to the second spring support portion and in a cylindrical shape in order to house the second spring support portion in an inside thereof and in order that a temporary holding portion that is able to hold the other end of the tension spring passes through the opening in a case where a temporary holding member having the temporary holding portion is mounted on the holding body, housing the second spring support portion in the temporary holding portion in a case where the moving body is movably supported on the holding body from a state where the tension spring is supported between the first spring support portion and the temporary holding portion, and supporting the other end of the tension spring falling off from the temporary holding portion in a case where the temporary holding member is removed from the holding body.

* * * * *